US005865641A

United States Patent [19]

Swart et al.

[11] Patent Number: 5,865,641

[45] **Date of Patent: *Feb. 2, 1999**

[54] SOLID SPRING ELECTRICAL CONTACTS FOR ELECTRICAL CONNECTORS AND PROBES

[75] Inventors: Mark A. Swart, Upland; Charles J. Johnston, Walnut, both of Calif.

[73] Assignee: Delaware Capital Formation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 536,131

[22] Filed: Sep. 29, 1995

Related U.S. Application Data

[63] Continuation of Ser. No. 274,296, Jul. 12, 1994, abandoned.

[51] Int. Cl.[6] ..... H01R 13/05

[52] U.S. Cl. ..... 439/482; 439/824

[58] Field of Search ..... 439/66, 70–73, 439/78–83, 88, 91, 591, 824, 840, 841, 851–856, 861, 862, 482, 700; 324/754, 761, 757

[56] References Cited

U.S. PATENT DOCUMENTS

| | | | |
|---|---|---|---|
| 2,922,948 | 1/1960 | Washburn | 324/29.5 |
| 4,161,346 | 7/1979 | Cherian et al. | 439/66 |
| 4,199,209 | 4/1980 | Cherian et al. | 439/591 |
| 4,307,928 | 12/1981 | Petlock, Jr. | 439/824 |
| 4,647,126 | 3/1987 | Sobata, Jr. | 339/17 |
| 4,773,877 | 9/1988 | Krüger et al. | 439/482 |
| 4,778,404 | 10/1988 | Pass | 439/387 |
| 4,967,148 | 10/1990 | Doemens et al. | 324/158 |
| 5,015,947 | 5/1991 | Chism | 324/158 |
| 5,055,777 | 10/1991 | Bonelli et al. | 324/158 |
| 5,113,133 | 5/1992 | Conti et al. | 324/158 |
| 5,152,694 | 10/1992 | Bargain | 439/66 |
| 5,199,895 | 4/1993 | Chang | 439/326 |
| 5,308,252 | 5/1994 | Mroczkowski et al. | 439/66 |
| 5,366,380 | 11/1994 | Reymond | 439/66 |

FOREIGN PATENT DOCUMENTS

| | | | |
|---|---|---|---|
| 0030574A1 | 6/1981 | European Pat. Off. . | |
| 3507464 A1 | 9/1985 | Germany . | |
| 1310929 | 5/1987 | U.S.S.R. | 439/482 |
| 2273830 | 6/1994 | United Kingdom . | |

*Primary Examiner*—P. Austin Bradley
*Assistant Examiner*—Tho Dac Ta
*Attorney, Agent, or Firm*—Christie, Parker & Hale, LLP

[57] ABSTRACT

A solid spring electrical connector includes an elongated metal bar of sufficient cross sectional area to carry high electrical current loads. The bar is contained in a barrel with terminals of the bar projecting from opposite ends of the barrel. The bar is an integral piece which includes a spring section extending most of the length of the bar. The spring section is formed by axially spaced-apart, parallel, linear, narrow-profile notches of generally uniform width having alternating open ends facing toward opposite sides of the bar progressively along its length. Each notch extends across a major portion of the diameter of the bar thereby forming a resilient spring section in which the metal between adjacent notches forms the equivalent of long narrow flexible beams with alternating pivot points. In an alternate embodiment, electrical connectors adapted for mounting to printed circuit boards include a plurality of spring contacts in a row along the length of the connector. Each spring contact comprises one or more thin, flat, metal pieces with a spring section extending most of the length of each metal piece. The spring contacts are spaced-apart by insulating blocks interleaved between the contacts. The spring section of each flat metal piece includes long, narrow, parallel notches that alternately open to opposite sides of the metal piece. A multi-layer form of each contact includes overlying notched metal pieces positioned face to face with openings of corresponding notches in adjacent pieces facing in alternate directions to control high frequency response.

50 Claims, 10 Drawing Sheets

Fig. 21
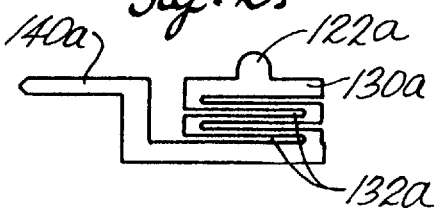
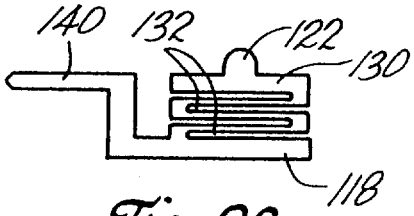
Fig. 22
Fig. 23
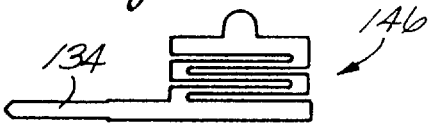
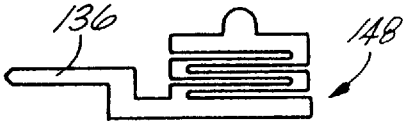
Fig. 24

SOLID SPRING ELECTRICAL CONTACTS FOR ELECTRICAL CONNECTORS AND PROBES

CROSS-REFERENCE TO RELATED APPLICATION

This is a continuation of application Ser. No. 08/274,296, filed Jul. 12, 1994 now abandoned.

FIELD OF THE INVENTION

This invention relates to electrical connectors, and more particularly, to spring contacts for use in connectors in which each spring contact is an integral piece or bar of metal with a spring section formed integrally between terminals of the contact. The spring contact avoids the need for a separate compression spring and plunger commonly used in spring contacts or probes.

BACKGROUND OF THE INVENTION

Resilient contact pins of electrical connectors often include a plunger guided linearly in a slot with a separate compression spring for producing spring-biased travel of the plunger in the slot. Spring probes for electrical test fixtures also include such a separate plunger and spring contained in an outer barrel for use in testing electrical continuity between test points of circuits on a printed circuit board, for example. U.S. Pat. No. 4,773,877 to Kruger et al. discloses a contactor for an electronic tester in which the contactor includes a one-piece resilient contact pin having a guided plunger at one end and a spring section at the other end. The plunger section and spring section are integrally joined and formed from a common sheet metal piece. The particular form of the contactor shown in the Kruger '877 patent would not be useful as an electrical connector for carrying high current loads subjected to constant cycling. The Kruger '877 contactor also would not be useful for high-density spring contacts in a miniaturized connector adapted for mounting to a printed circuit board and also subjected to constant cycling.

The present invention overcomes the drawbacks of the Kruger '877 contactor by providing a solid metal compliant high current carrying electrical connector, and in another form of the invention, by providing solid metal compliant contacts for several forms of miniaturized connectors adapted for mounting to printed circuit boards.

One prior art high current electrical connector commonly used in subway cars, for example, includes a movable plunger biased by a compression spring contained in an outer barrel. The plunger has a drilled cross-hole that receives a copper braid extending along opposite sides of the plunger and through the cross hole. The ends of the braid are soldered to the barrel. The braid is used to carry the high current independently of the spring. There are many disadvantages of this connector including its high cost of parts and assembly. In addition, the spring can take a set from cycling during use, and the braid is subject to fatiguing wear during use.

SUMMARY OF THE INVENTION

Briefly, one embodiment of the invention comprises a solid spring electrical connector which includes an elongated metal bar of sufficient cross sectional area to carry high electrical current loads. The bar is contained in a barrel with terminals of the bar projecting from opposite ends of the barrel. The bar is an integral piece which includes a spring section extending most of the length of the bar. The spring section is formed by axially spaced-apart, parallel, linear, narrow-profile notches of generally uniform width having alternating open ends facing toward opposite sides of the bar progressively along its length. Each notch extends across a major portion of the diameter of the bar thereby forming a resilient spring section in which the metal between adjacent notches forms the equivalent of long narrow flexible beams that compress under an axial force about alternating pivot points spaced axially along the length of the contact. This form of the invention is useful as a high current capacity electrical connector subjected to constant cycling during use.

In an alternate embodiment of the invention, electrical connectors adapted for mounting to printed circuit boards include a plurality of spring contacts in a row along the length of the connector. Each spring contact comprises one or more thin, flat metal plates with a spring section extending most of the length of each metal plate. The spring contacts are spaced-apart by insulating blocks interleaved between the contacts. The spring section of each flat metal plate includes long, narrow, parallel notches that alternately open toward opposite sides of the metal plate. A multi-layer form of each contact includes overlying notched metal plates positioned face to face with openings of corresponding notches in adjacent plates facing in alternate directions to control high frequency response. The multi-layer form of each contact provides separate independent compliance of each contact plate in the multi-layer contact. This enhances electrical contact between the connector and the terminals engaged by the contacts.

These and other aspects of the invention will be more fully understood by referring to the following detailed description and the accompanying drawings.

BRIEF DESCRIPTION OF THE DRAWINGS

FIGS. 21–24 are elevational views showing the different embodiments of the contact plates used in the edge connector of FIG. 19.

DETAILED DESCRIPTION

Figure 1:
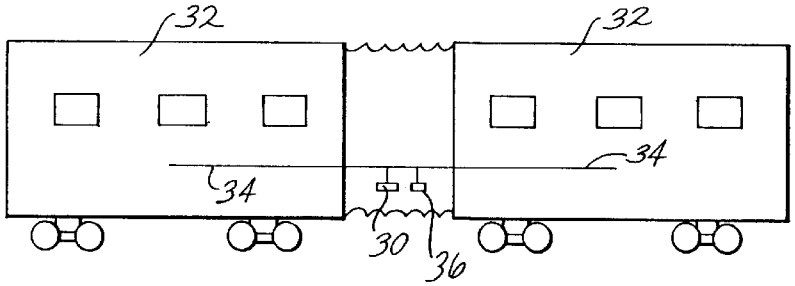
FIG. 1 is a schematic diagram illustrating use of a high current capacity compliant connector of this invention for coupling electrical circuits joined to an electrical power bus in subway cars.
Figure 2:
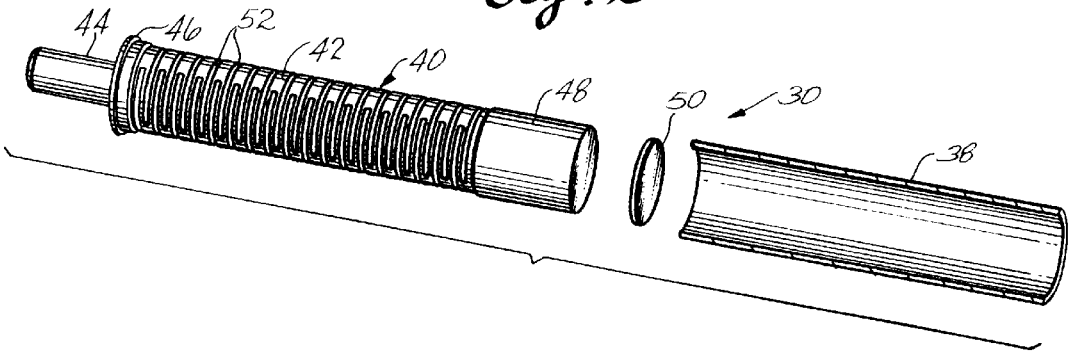
FIG. 2 is an exploded perspective view illustrating components of the high current connector.
Figure 3:
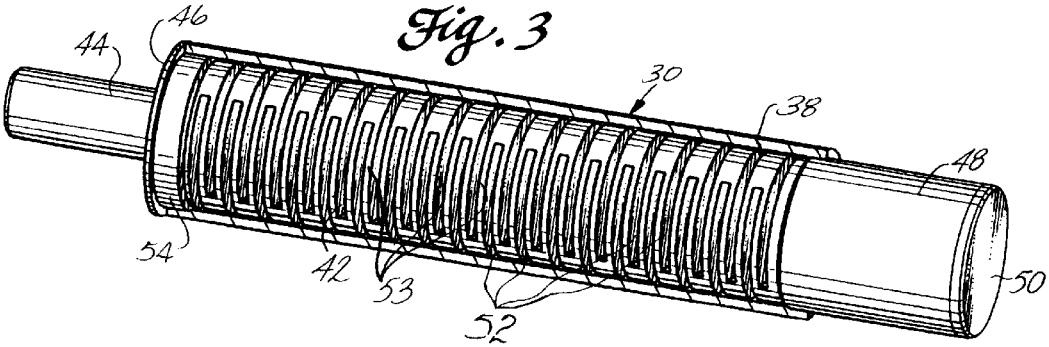
FIG. 3 is a perspective view, partially cut away showing an assembled form of the connector of FIG. 2.

Referring to the drawings, FIGS. 1 through 3 illustrate one embodiment of the invention which comprises a compliant electrical connector 30 useful for high electrical current carrying applications. FIG. 1 illustrates an example of one use of the connector 30 as a connector for an electrical bus for subway cars. FIG. schematically illustrates a pair of subway cars 32 connected together in the usual manner. The cars each contain a separate electrical bus 34 that supplies electrical power for a variety of functions such as operation of the motor, lights, brake systems and the like. Electrical control circuits that receive power from the bus 34 are connected by the compliant connectors 30 which join together automatically as the subway cars connect together. Terminals 36 on electrical circuits joined to the bus 34 are forcibly engaged by the compliancy of the connectors 30 to make continuous electrical and mechanical contact with the terminals. The high electrical current loads that pass continuously from one car to the next are carried by the intervening compliant connectors 30.

FIGS. 2 and 3 illustrate the detailed construction of the high current capacity connector 30 which comprises an assembly that includes an elongated cylindrical tubular outer barrel 38 made from an electrically conductive material, and a solid metal one-piece electrical contact member 40 contained within the barrel. The contact member 40 has a solid metal spring section 42 extending most of the length of the contact member. Axially extending terminals integral with opposite ends of the contact member project from opposite ends of the barrel. The terminals include a narrow profile terminal 44 at one end which is integral with a flange 46 that engages the outer end wall of the barrel. A wider diameter terminal or plunger section 48 at the opposite end of the contact member has a diameter similar to the diameter of the spring section 42 of the contact member. A hard metal facing is provided by a separate cap 50 joined to the wider diameter terminal 48. In use, the spring section 42 is compliant axially and moves into the barrel toward the terminal 44 under axial pressure directed against the facing 50. The solid one-piece contact member provides both the mechanical compliancy and a continuous electrical contact path between the terminals of external electrical circuits when such terminals are forced axially against the terminals of the compliant contact member.

The contact member 40 is preferably formed from a solid metal bar of generally uniform cross-sectional configuration. The circular cross-section shown in the drawings is preferred although a square cross section is also useful for the purposes of this invention. The solid metal bar has a sufficient cross-sectional area to provide high current carrying capacity, and its preferred dimensions are described below. The spring section 42 is preferably formed by alternating saw cuts that form slots 52 extending linearly across most of the diameter of the metal bar. The direction of the saw cuts is perpendicular toward the central axis of the bar, from both sides of the bar. The slots have openings that alternate from one side to the other along the length of the contact member. The slots are thin, narrow-profile, uniform in diameter, and parallel to each other progressively along most of the length of the contact member. A short uncut section 54 is left inboard from the flange 46 at one end of the contact member. The terminal or plunger section 48 at the opposite end is left uncut for about 15 to 20 percent of the length of the contact member, and this terminal section matches the inside diameter of the outer barrel.

The solid metal sections of the contact member that are left between the slots 52 provide the equivalent of long, narrow, parallel beams 53 each of which deflects through a separate shallow angle at separate bases or pivot points that are alternately spaced-apart along the opposite sides of the spring contact member. This provides good spring compliancy in the axial direction for providing a continuous high current carrying path for transmitting electrical power through the connector from one terminal to the other.

The narrow profiles of the beams and the slots on opposite sides of the beams are formed by the radial depth of the slot (the distance from the central axis of the spring section to the closed end of the slot being substantially longer than the thickness of the beams on opposite sides of the slot.

In one embodiment of the high current capacity connector, the diameter of the cylindrical bar is approximately 0.413 inch and the length of the bar is about 2.6 inches. The slots and the beams are each of uniform size and shape. The width of each slot is about 0.025 inch, and the slots have an on-center spacing of 0.90 inch along each side of the connector body, or 0.045 inch between adjacent slots. The width of each beam is therefore about 0.020 inch. The depth of each slot is about 0.375 inch, i.e., approximately 90 percent of the diameter of the contact member. The preferred depth is greater than about 80 percent of the diameter while being sufficient to maintain compliancy and retain the high-current capacity of the contact member. The material from which the contact member is made is beryllium copper, the preferred material being alloy III from Brush Wellman. The terminal facing 50 is preferably made from a silver/cadmium oxide cap with a screw threaded shaft that screws into an internally threaded hole (not shown) in the body of the connector. At the opposite end of the connector, the terminal 44 may be screw threaded externally and pressed onto the end of the spring contact body.

The narrow profile shape and close spacing of the beams that form the spring section of the contact member are critical in the function of the spring contact. The ratio of the width of each beam (measured between two adjacent slots) and the length of each beam (measured by the depth of the slot) is preferably less than about ten percent, more preferably less than about eight percent, and in the illustrated embodiment the ratio is about five percent. This produces the equivalent of long narrow beams with their pivot points offset from one side to the other along the length of the solid metal contact member. The low profile and close spacing produces long narrow beams that each deflect through a shallow angle when the spring section is compressed. As a result, and during use in which high contact forces are applied to the contact member from constant coupling to the external terminals that apply such forces, the shallow deflection angles of the beams reduce fatigue that can otherwise be produced from shorter and wider beams with wider spacing such as with the contactor shown in the patent to Kruger '877.

The electrical connector described above is useful in applications requiring high current-carrying capacity of at least about ten amperes continuous under the compressed state of the spring. The connector in one embodiment is useful for subway cars which require 30 amps continuous service and 90 amps to 120 amps peak current load for at least one-half hour under an applied force of at least six pounds. In one experimental test the connector successfully produced high current flow at 30 amps continuous at 107° F. and 100 amps peak for thirty minutes at the same temperature with test forces greater than about six pounds.

FIGS. 4 through 24 illustrate an alternate form of the invention comprising miniaturized electrical connectors in which the contacts for the connector are made from integral solid metal compliant contact members, i.e., input/output terminals of the contact member are joined integrally by a solid metal spring section that provides compliancy and the electrical current carrying function of the contact member.

Figure 4:
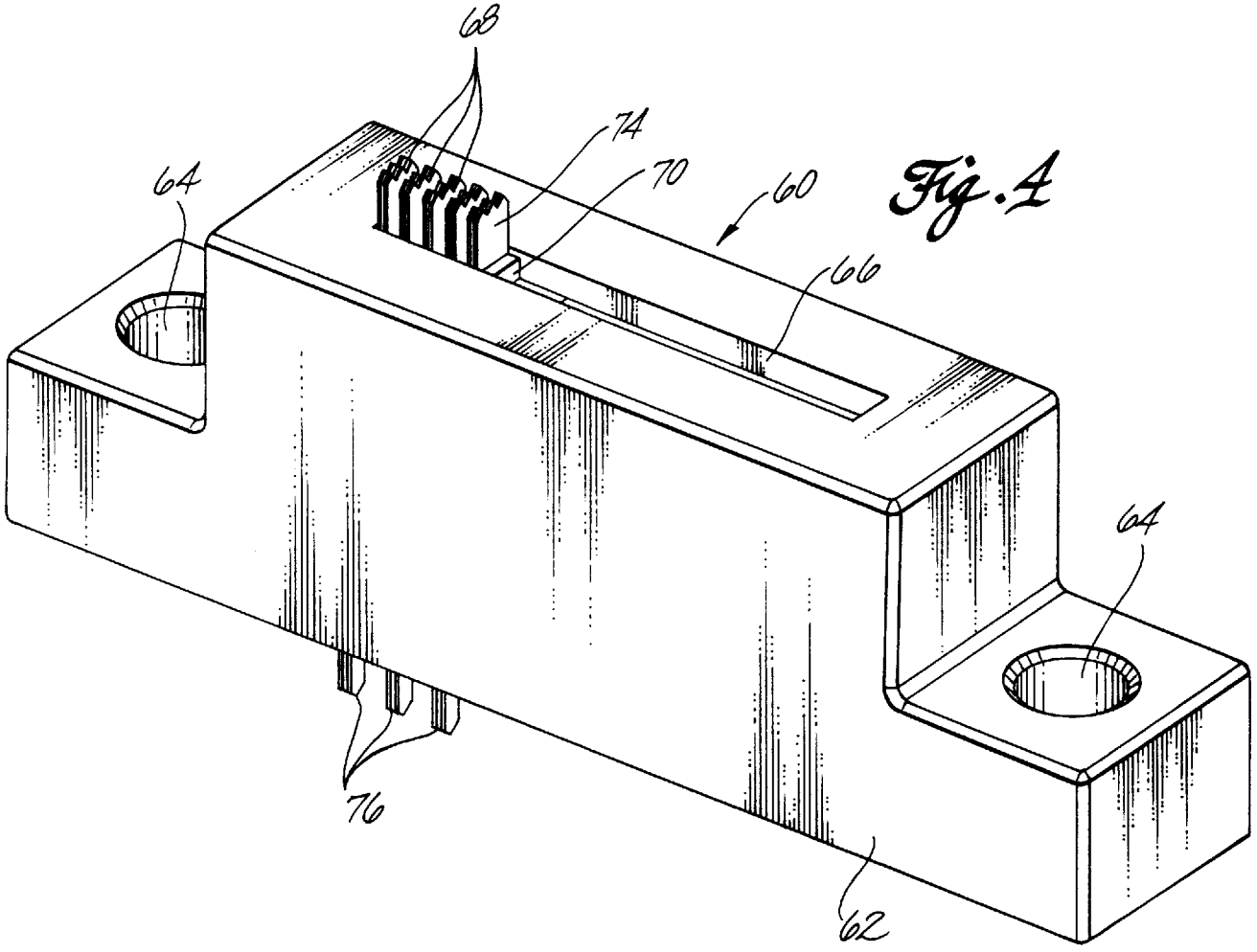
FIG. 4 is a perspective view illustrating an alternative form of the invention in which solid metal compliant spring contact plates form multi-layer contacts in an electrical connector adapted for mounting to thru-holes in a printed circuit board.
Figure 5:
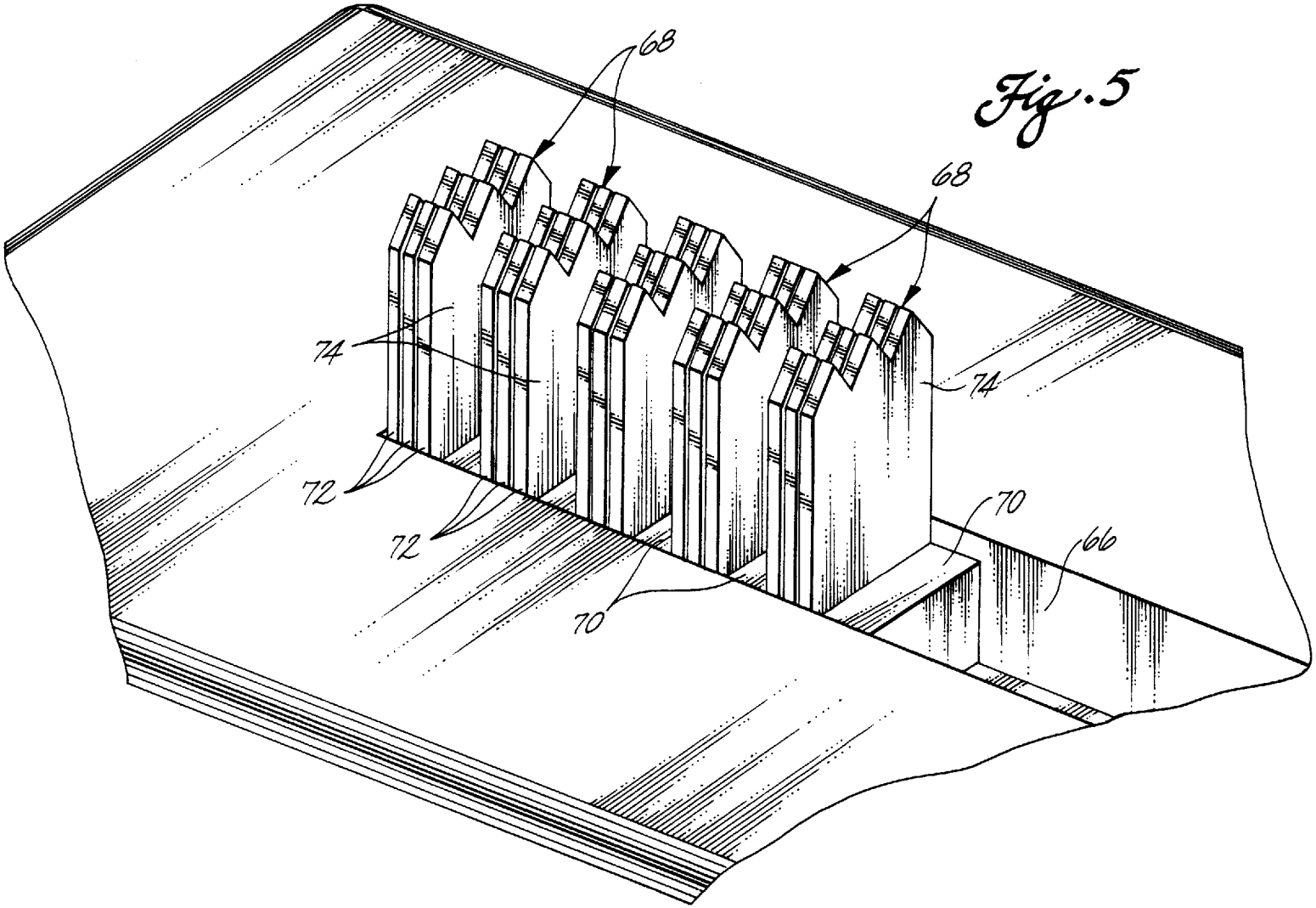
FIG. 5 is an enlarged fragmentary perspective view showing details of the connector shown in FIG. 4.

FIGS. 4 through 7 illustrate one embodiment of an electrical connector 60 adapted for mounting to thru-holes in a printed circuit board. Referring to FIGS. 4 and 5, the connector includes a solid block 62 made from an electrically insulative plastic material. The block has mounting holes 64 at opposite ends for mounting the connector to a printed circuit board. A long, narrow, linear slotted opening 66 extends through the depth of the block from top to bottom so that the slotted opening faces both sides of the connector block. Separate multi-layer electrical contacts 68, also referred to as a contact assembly, are aligned in the slot. The contacts are spaced-apart and electrically isolated by intervening blocks 70 of an electrically insulative plastic material. The contacts 68 thus extend vertically and are spaced-apart uniformly along the length of the slotted opening 66. Upper terminals 74 of the contacts are spaced-apart in a row along the top of the connector and lower terminals 76 of the contacts are also spaced-apart in a row and project from the bottom of the connector.

Figure 6:
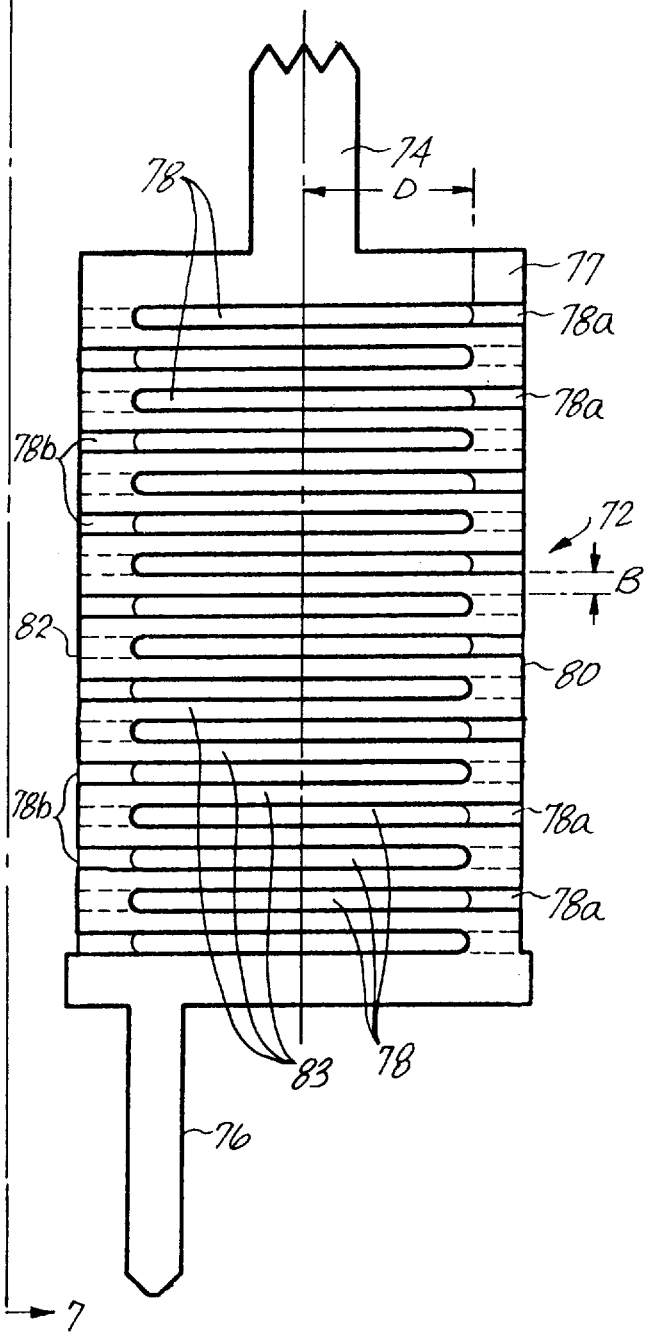
FIG. 6 is a side-elevational view illustrating a multi-layer contact used in the connector of FIG. 4.
Figure 7:
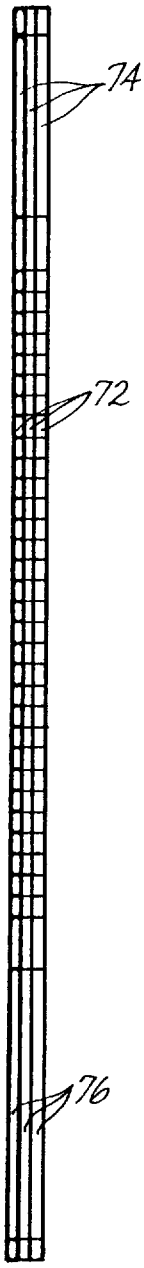
FIG. 7 is a side-elevational view taken on line 7—7 of FIG. 6.
Figure 8:
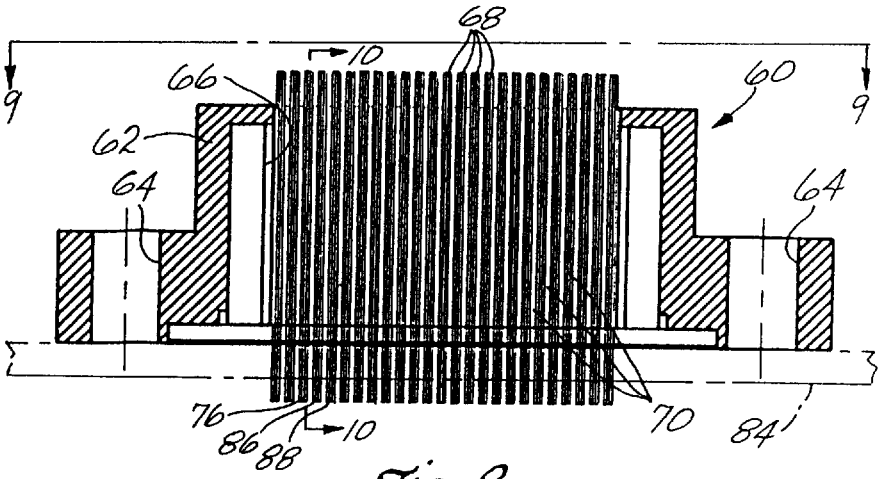
FIG. 8 is a cross-sectional view of the connector shown in FIG. 4.
Figure 9:
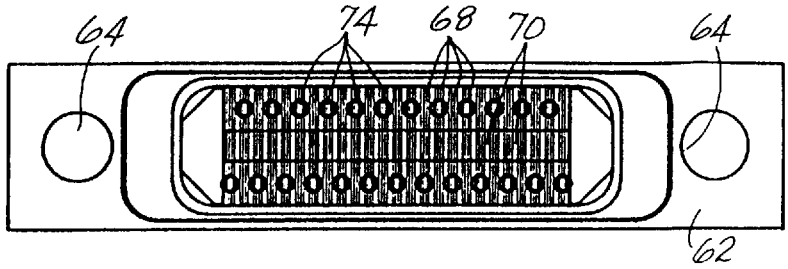
FIG. 9 is a top plan taken on line 9—9 of FIG. 8.
Figure 10:
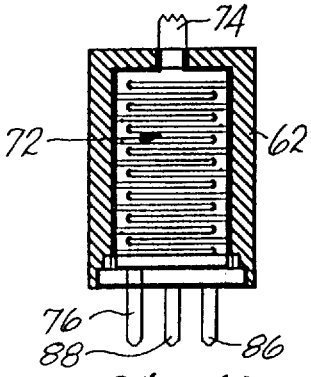
FIG. 10 is a cross-sectional view taken on line 10—10 of FIG. 8.

FIG. 5 illustrates the multi-layer contacts 68 each of which is formed by overlaying a plurality of thin metal compliant contact plates 72 shown best in FIGS. 6 and 7. Each contact plate has a narrow profile upper terminal 74 at one end, a separate narrow profile lower terminal 76 at the opposite end, and a generally rectangular spring section 77 formed integrally between the terminals. The figures illustrate three-piece multi-layer contacts 68 in which each contact comprises three separate overlying thin metal contact plates 72 which are in face-to-face contact from one end of the contact plate to the other. Although the number of contact plates in a given electrical contact can vary, and the preferred number of plates in a given contact can range from two to five, more plates can be used, and in fact, a single plate is believed to be useful in certain instances. The presently preferred embodiment is the illustrated three-piece multi-layer contact shown in the drawings of the various embodiments for simplicity.

The spring section 77 of each contact plate 72 includes a plurality of long, narrow, linear slots 78 of uniform width and spacing extending parallel to one another along the length of the rectangle, perpendicular to the outer edges of the rectangle. The openings to the slots alternate from one side of the rectangle to the other progressively along the length of the plate. Thus, in the embodiment illustrated in FIG. 6, alternate slots 78 have open ends 78*a* facing toward a vertical edge 80 of the plate, and the slots which are intervening have open faces 78*b* facing toward an opposite vertical edge 82 of the plate which is parallel to the vertical edge 80. The alternating slots extend along most of the length of the rectangular section 77 of the contact plate.

The multi-layer contacts are preferably formed by overlaying three of the contact plates 72 face-to-face, but by reversing the position of the center plate in the stack so that corresponding openings to the slots face toward one edge of the first and third plates and are closed in the center plate along the same edge, while on the opposite side of the stack corresponding slots that open toward the edge of the center plate are closed in the overlying first and third plates. This alternating arrangement, best illustrated in FIG. 6, thereby produces an undulating or serpentine conductive path through the metal (the beams referred to previously) in each plate, and these serpentine conductive paths are of matching aligned configuration in the first and third plates but are offset in the middle plate of the stack. In use, the rectangular spring sections of the overlying faces of the contact plates are free to slide on each other and move independently relative to each other since the overlying plates are not physically joined to each other in each multi-layer contact.

The pattern of the middle plate in the stack varies from the first and third plates in that the lower terminal 76 is offset to one side of the middle plate compared to the offset of the terminal 76 in the first and third plates, so that when the spring section of the center plate is reversed relative to the first and third plates, the three lower terminals 76 are aligned to form a single multi-layer terminal shown in FIG. 6. The upper terminals 74 have serrated upper edges to provide good contact with an external terminal with which the contact is engaged during use.

In response to a contact force applied to the upper terminal 74, the spring section of each rectangle is resiliently compressed owing to the alternating slotted openings extending along the length of the spring section of each contact plate. The three contact plates in each multi-layer contact are thus able to slide freely and provide independent compliance as they slip face-to-face relative to one another. This enhances physical contact between the contact assembly and the external terminal to which it connects. The multi-layer contacts are each held in place in the slotted opening of the housing by the intervening insulating blocks 70 and by a separate cover (not shown), or an internal detent (not shown), to confine the contact plates of each contact assembly to the connector block while allowing their independent compliancy.

The alternating offset serpentine (mirror image) conductive paths formed by adjacent contact plates in a given contact is provided in order to cancel out or at least reduce high frequency effects. It is believed that the alternating conductive paths provided by flip flopping the adjacent conductive plates relative to one another prevents the contact assembly from acting as a coil and thereby improves high frequency response.

The rectangular spring section of the contact plates 72 is formed in the manner similar to the high current contactor shown in FIGS. 2 to 3 in the sense that the separate notched areas are of narrow profile, uniform in diameter, and extend across most of the width of the rectangular section of the connector plate. The solid metal sections of each contact plate that are left between the notches provide the equivalent of long, narrow, parallel beams 83 each of which deflects through a separate shallow angle at separate bases or pivot points that are alternately spaced-apart along the opposite sides of the contact plate.

The narrow profiles of the beams 83 and the slots 78 on opposite sides of the beams are formed by the radial depth (the distance D in FIG. 6) of the slot (the distance from the central axis of the spring section to the closed end of the slot) being substantially longer than the thickness of the beams (the distance B in FIG. 6) on opposite sides of the slot. This radial depth is preferably at least two to three times the beam thickness and in one embodiment said radial depth is more than about five times the beam thickness. In a preferred embodiment shown in FIG. 6, each contact plate is about 0.005 inch in thickness, the width of each slotted opening is about 0.010 inch, the width of each beam is about 0.010 inch, the length of each slot is about 0.180 inch, the overall width of the rectangular section is about 0.210 inch, and its height is about 0.360 inch. Thus, each beam can be considered to have an effective length of about 0.180 inch. The ratio of the beam width to length is less than about ten percent and in the illustrated embodiment this ratio is about six percent. The preferred material for the contact plate is beryllium copper.

The preferred technique for forming the slots in the contact plates is by etching.

Figure 13:
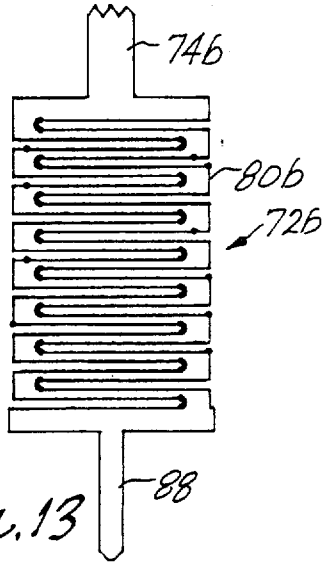
FIGS. 11–13 are elevational views showing different embodiments of the separate multi-layer contacts used in the connector of FIG. 8.
Figure 12:
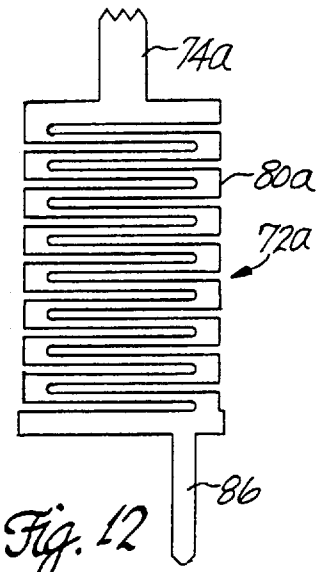
Figure 11:
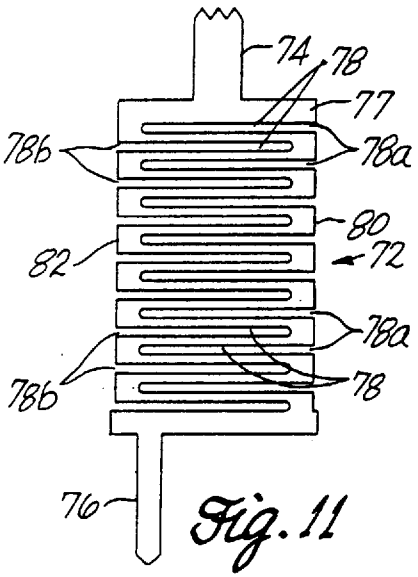
Figure 14:
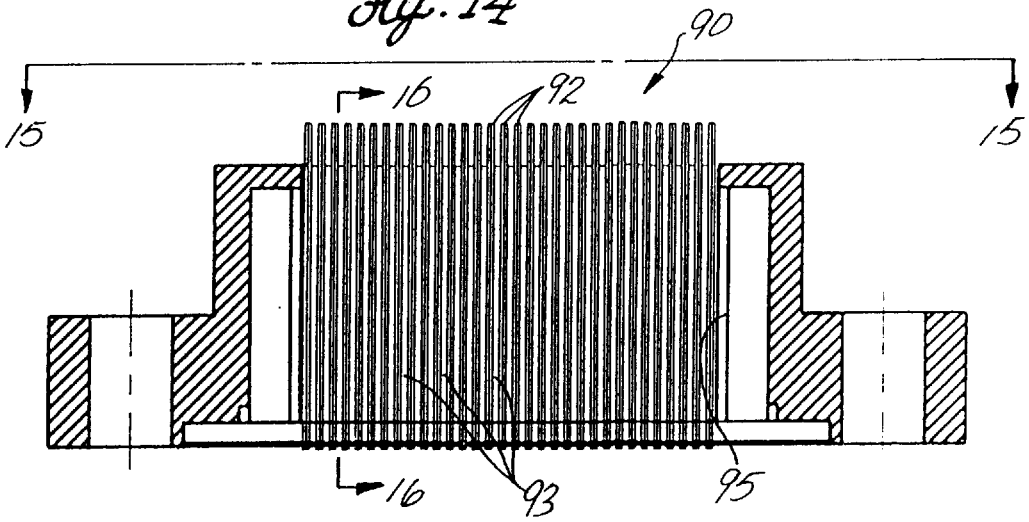
FIG. 14 is a cross-sectional view showing an alternative form of the invention in which the solid spring contacts are used in a surface-mount connector.
Figure 15:
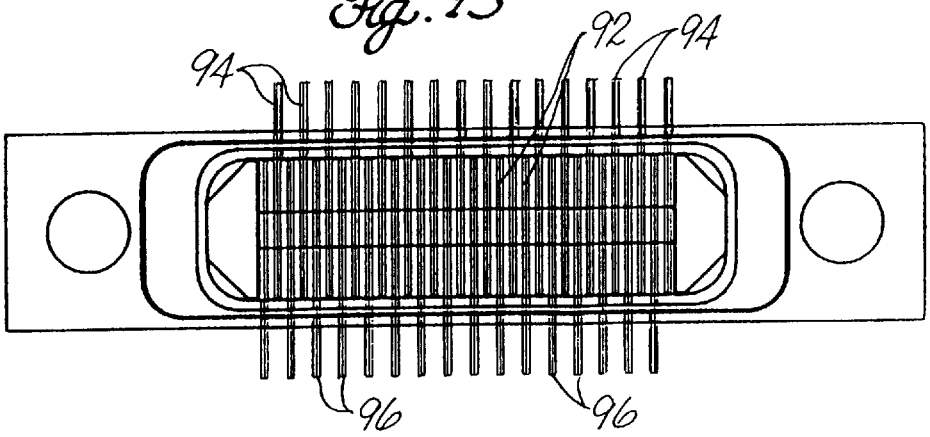
FIG. 15 is a top plan view taken on line 15—15 of FIG. 14.
Figure 18:
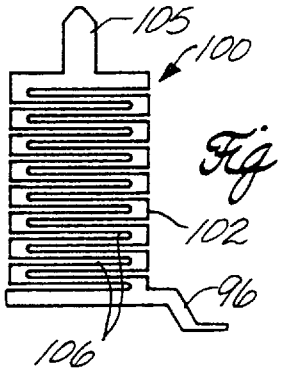
FIGS. 17 and 18 are separate elevational views showing the two different embodiments of the electrical contacts used in the connector of FIG. 14.
Figure 17:
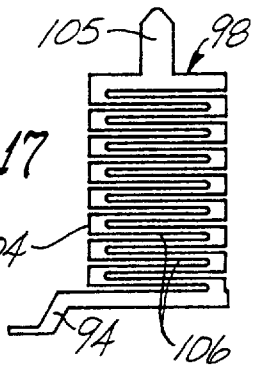
Figure 16:
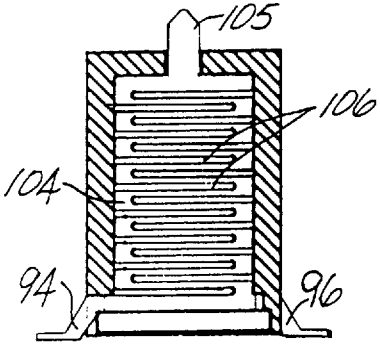
FIG. 16 is a cross-sectional view taken on line 16—16 of FIG. 14.

FIGS. 9 through 13 are further illustrations of the electrical connector 60 shown in FIGS. 4 through 7. The connector is shown in its assembled form having the multi-layer contacts 68 spaced-apart along the length of the slotted interior 66 of the connector block 62. These illustrations also show the lower terminals 76 that project downwardly away from the bottom of the connector housing which are adapted for mounting in thru-holes of a printed circuit board 84. Preferably, the lower terminals 76 of adjacent contacts 68 are offset laterally across the width of the connector housing 62, as shown best in FIG. 10. Thus, in one multi-layer contact 68, the lower terminals 76 can be offset to the left side of the overlying contact plates, the lower terminals 86 of the adjacent contact can be offset to the right side of its overlapping contact plates, and the lower terminals 88 of the contact plates of the next contact in series are centered. These three forms of the contact plates 72, 72*a* and 72*b* are shown in FIGS. 11 through 13, respectively.

FIGS. 15 through 18 show an alternative form of the invention which comprises a miniaturized surface-mount connector 90. In this embodiment, there are multi-layer contacts 92 spaced-apart axially along a slotted open area 94 within the outer housing. Separate insulating blocks 93 are spaced apart between the adjacent multi-layer contacts 92. The contacts 92 have surface-mount terminal legs 94 projecting alternately from one side of the connector housing and separate surface-mount terminal legs 96 projecting alternately from offset intervening contacts on the other side of the housing. Each contact 92 preferably comprises three overlying contact plates assembled from the contact plates 98 and 100 shown in FIGS. 17 and 18. The contact plate 100 is a mirror image of the contact plate 98 in the sense that a three layer contact includes first and third contact plates 98 with the contact plate 100 reversed in position between them so that all lower terminal legs 96 project to a common side of the connector housing. This arrangement also reverses the signal flow in the spring section 102 of the central plate 100 compared with the signal flow in the spring section 104 of the outer plates (first and third plates 98) of the contact assembly. This reversed signal flow from plate to plate provides the high frequency characteristics described previously.

The offset spacing of the surface-mount terminal legs along each side of the connector housing widens the spacing among contacts that are surface mounted to the printed circuit board while providing a higher density of multi-layer contacts.

The contacts also include an upper terminal leg 104 aligned axially along the top of the connector, and in use, a downward force on the upper terminal leg 104 compresses the solid integral rectangular spring section of each surface-mount spring. The spacing among the notches 106 is similar to that described for the embodiment shown in FIGS. 9 through 13 and thus the adjacent beams formed by the continuous metal of the contact plates provides shallow, angular deflections providing independent compliancy among the contact plates in each contact assembly.

FIGS. 20 through 24 show a further embodiment of the invention in the form of an edge connector 110 for a printed circuit board 112 that slides into a gap 114 between rows of upper and lower contacts 116 and 118 positioned above and below the gap, respectively. Each contact 116, 118 in the connector is a multi-layer contact formed preferably by three overlapping contact plates, as described above, although this number of plates per contact can vary. Each upper contact 116 includes a multi-layer tab 120 projecting downwardly into the top center portion of the gap, and each lower contact 118 includes a multi-layer tab 122 projecting upwardly into the lower center of same gap. The gap 114 extends along the length of the connector housing 124 as shown best in FIG. 12, with the upper tabs 120 and lower tabs 122 of the corresponding contacts being aligned vertically with one another and spaced apart axially along the gap.

Each upper contact plate also includes a rectangular integral spring section 126 with long narrow profile slots 128 extending parallel to each other inwardly from alternating opposite edges of the rectangle. The spacing between the slots (and the row of beams) extends axially away from the lower tab of the upper contact plate. Similarly, each lower contact plate includes a rectangular spring section 130 with long narrow profile slots 132 extending parallel to each other inwardly from alternating opposite edges of the rectangle.

The upper and lower contacts also have separate outer terminal legs integral with the rectangular spring section and extending outwardly from the side of the connector in a direction generally parallel to the axis of the printed circuit board. In the row of upper contacts the outer terminal legs of adjacent contacts project from three different levels in series along the length of the connector, thereby forming upper terminal legs 134, intermediate terminal legs 136, and lower terminal legs 138, and so on, for the row of the upper contacts 116. Similarly, the lower contacts 118 have their terminal legs extending away from three separate levels in adjacent contacts thereby forming upper terminal legs 140, intermediate terminal legs 142, and lower terminal legs 144 alternating in series along the length of the connector.

FIGS. 21 through 24 illustrate alternative forms of the spring contact plates that form the multi-layer upper and lower contacts having terminal legs at different levels along the length of the connector housing. FIGS. 21 and 22 illustrate the preferred form of the contact plates that form the lower contacts 118 with the upper terminal leg 140. This three layer form of the lower contact is provided by sandwiching the center contact plate of FIG. 22 between outer contact plates in the form shown in FIG. 21. This results in the upper terminal legs 140 and 140*a* overlying one another at the same level, the tabs 122 overlying one another above the spring section of the contact, and the center contact plate (FIG. 21) having its electrical path reversed and offset with respect to the electrical path of the outer contact plates (FIG. 22).

The upper contact 116 with the lower terminal leg 138 can be formed by overlying the contact plates of FIGS. 21 and 22 in a similar manner.

Further, the contact plate 146 shown in 23 can be in the form shown and in a reversed form to similarly produce both a three-layer contact for an upper contact with the leg 134 and a lower contact with the leg 144, together with the spring sections thereof having the electrical path of the center contact plate reversed with respect to the outer contact plates.

In a similar manner, the contact plate 148 shown in FIG. 24 can form upper and lower contacts with the intermediate terminal legs 136 and 142, with the spring section of each such contact being reversed with respect to the pattern shown in FIG. 24 to provide the reversed electrical path with respect to the outer overlying plates of the same connector.

Figure 19:
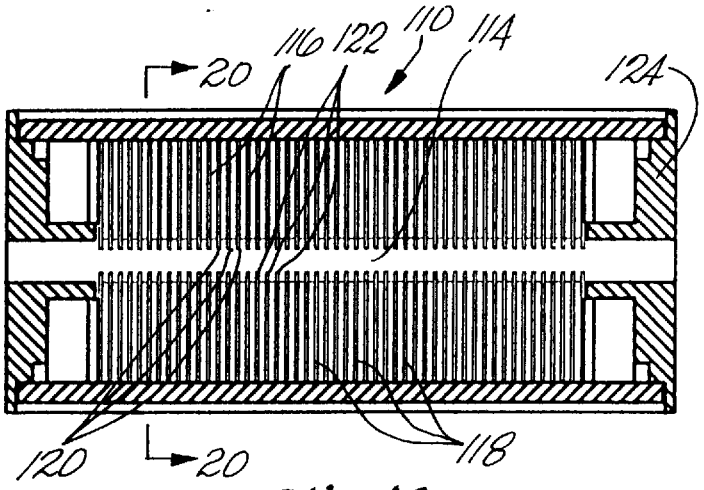
FIG. 19 is a further alternative embodiment of the invention showing use of the solid spring contacts in an edge connector for a printed circuit board.
Figure 20:
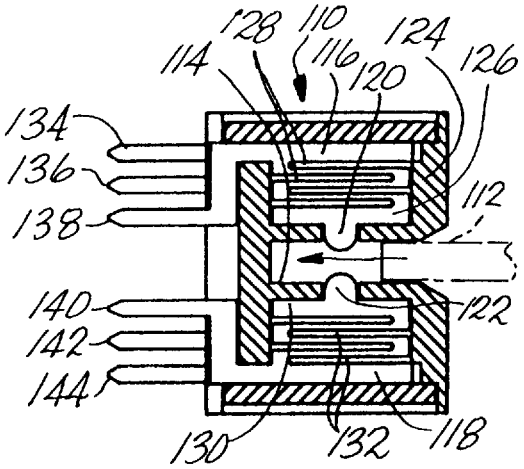
FIG. 20 is a cross-sectional view taken on line 20—20 of FIG. 19.

The electrical connector shown in FIGS. 19 and 20 slips over the edge of the printed-circuit board 112 with the tabs of the connectors engaging terminals on opposite faces of the board. The spring sections of the upper and lower contacts are biased away from the printed circuit board to hold the connector in place at the edge of the board. The spring sections of the contact plates in each contact compliantly move relative to one another independently to provide good contact with the board at the tabs. The terminal legs project outwardly at different levels to enlarge the spacing among contacts at different levels while providing high linear density among adjacent contacts along the connector housing.

What is claimed is:

1. An electrical connector for making compliant electrical contact between a pair of external electrical terminals, the connector having at least one compliant contact member guided for linear travel in a connector housing, the compliant contact member comprising a one-piece body of an electrically conductive material having terminal sections at opposite ends adapted for contact with said external electrical terminals, and a compliant spring section integral with and extending between said terminal sections, the compliant spring section comprising an elongated member having a predetermined length and width and a central axis extending lengthwise and having long, narrow, generally parallel slots alternately opening toward opposite edges of the spring section, each slot extending from an open end at one edge of the spring section across the width of the spring section to a closed end adjacent an opposite edge of the spring section, to form a series of long, narrow-profile beams of electrically conductive material between adjacent slots, in which the beams individually deflect so as to cause the spring section to compress axially under an axial force applied to at least one of said terminal sections, the slots adjacent opposite sides of each beam having a radial depth defined by the distance from the central axis of the spring section to the closed end of the slot, the narrow profile of the beams being formed by the narrow slots on opposite sides of the beam having said radial depth extending for a distance at least three times greater than the thickness of the beams on opposite sides of the slot so that the beams individually deflect through shallow angles about respective pivot points alternating in position along the length of the spring section when the spring section is compressed by said axial force.

2. Apparatus according to claim 1 in which the connector includes a plurality of electrically isolated and spaced-apart compliant contact assemblies each adapted for contact with corresponding external electrical terminals, each contact assembly including a plurality of said contact members positioned face-to-face and independently compliant via their respective spring sections.

3. Apparatus according to claim 2 in which the face-to-face contact members have the slots of the spring sections reversed as a mirror image to reduce high frequency effects.

4. Apparatus according to claim 1 in which the compliant contact member has a length and a cross-sectional area sufficient to conduct a high electrical current of at least 10 amperes through the length of the contact member.

5. Apparatus according to claim 4 in which the electrical contact member is capable of conducting at least 30 amperes continuous under an external applied axial force of at least six pounds.

6. An electrical connector for making compliant electrical contact between a pair of external electrical terminals for high current-carrying applications, the connector having at least one compliant contact member guided for linear travel in a connector housing, the compliant contact member comprising a one-piece body of an electrically conductive material having terminal sections at opposite ends adapted for contact with said external electrical terminals, and a compliant spring section integral with and extending between said terminal sections, the compliant spring section having a length and a width extending opposite edges, the spring section having long, narrow, generally parallel slots alternatively opening toward opposite edges of the spring section to form a series of long, narrow-profile beams of electrically conductive material between adjacent slots, in which the beams individually deflect so as to cause the spring section to compress axially under an axial force applied to at least one of said terminal sections, the narrow profile of the beams being defined by the slots on opposite sides of the beams having a depth of at least eighty percent of the width of the spring section, and in which the ratio of the beam thickness to the beam length is less than about ten percent, the contact member capable of conducting high current loads of greater than at least about 10 amperes continuous while in its compressed state.

7. Apparatus according to claim 6 in which said ratio is less than about six percent.

8. An electrical connector for making compliant electrical contact between a pair of external electrical terminals, the connector having at least one compliant contact assembly guided for linear travel in a connector housing, the compliant contact assembly comprising a plurality of separate one-piece contact plates of an electrically conductive material having terminal sections at opposite ends adapted for contact with said external electrical terminals, and a compliant spring section integral with and extending between said terminal sections, the compliant spring section of each contact plate having a length and a width and a pair of axially extending opposite edges, the spring section having long, narrow, generally parallel slots alternately opening toward opposite edges of the spring section to form a series of long, narrow-profile beams of electrically conductive material between adjacent slots, in which the beams individually deflect so as to cause the spring section to compress axially under an axial force applied to at least one of said terminal sections, the narrow profile of the beams defined by the slots having a depth at least about ten times the width of the beam which extends between adjacent slots, the contact plates of the contact assembly being disposed face-to-face so as to slide axially with individual compliance when at least one of its terminal sections receives said applied axial force.

9. Apparatus according to claim 8 in which the connector is a surface-mount connector.

10. Apparatus according to claim 8 in which the connector is adapted for mounting to thru-holes in a printed circuit board.

11. Apparatus according to claim 8 in which the connector is adapted for use as an edge connector for a printed circuit board, in which the connector has a gap that receives the edge of the circuit board, and in which one of said contact assemblies is spring-biased toward a top of the gap and a second of said contact assemblies is spring-biased toward a bottom of the gap so the spring sections of the two spring contact assemblies apply spring-biased pressure to opposite faces of the circuit board.

12. Apparatus according to claim 8 in which the contact plates of the contact assembly have the slotted openings of the spring sections reversed in face-to-face contact.

13. Apparatus according to claim 8 in which the depth of the slots is at least about ninety percent of the width of the spring section.

14. An electrical connector for making compliant electrical contact between a pair of external electrical terminals, the connector having at least one compliant contact member guided for linear travel in a connector housing, the compliant contact member comprising a thin, flat one-piece metal plate having terminal sections at opposite ends adapted for contact with said external electrical terminals, and a compliant spring section integral with and extending between said terminal sections, the compliant spring section having a length and a width and a pair of axially extending opposite edges, the spring section having long, narrow, generally parallel slots alternately opening through opposite edges of the spring section to form a series of long, narrow-profile beams of electrically conductive material between adjacent slots, in which the beams individually deflect so as to cause the spring section to compress axially under an axial force applied to at least one of said terminals sections, the narrow profile of the beams being formed by the slot adjacent the beam having a depth substantially greater than the thickness of the beams on opposite sides of the slot, and in which the narrow profile of the beams is defined by the slots having a depth of at least about ninety percent of the width of the spring section so that the beams individually deflect through shallow angles about respective pivot points alternating in position along the length of the spring section when the spring section is compressed by said axial force.

15. Apparatus according to claim 14 in which the connector is a surface-mount connector.

16. Apparatus according to claim 14 in which the connector is adapted for mounting to thru-holes in a printed circuit board.

17. Apparatus according to claim 14 in which the connector is adapted for use as an edge connector for a printed circuit board, in which the connector has a gap that receives the edge of the circuit board, and in which one of said contacts is spring-biased toward a top of the gap and a second of said contacts is spring-biased toward a bottom of the gap so the spring sections of the two spring contacts apply spring-biased pressure to opposite faces of the circuit board.

18. Application according to claim 14 in which the spring section is generally rectangular with essentially parallel opposite edges through which the slots alternately open.

19. Apparatus according to claim 14 in which the ratio of the beam thickness to beam length is less than about ten percent.

20. Apparatus according to claim 19 in which said ratio is less than about six percent.

21. Apparatus according to claim 14 in which the connector includes a plurality of electrically isolated and spaced-apart compliant contact assemblies each adapted for contact with corresponding external electrical terminals, each contact assembly including a plurality of said contact members positioned face-to-face and independently compliant via their respective spring sections.

22. Apparatus according to claim 21 in which the face-to-face contact members have the slots of the spring sections reversed as a mirror image to reduce high frequency effects.

23. An electrical connector for making compliant electrical contact between a pair of external electrical terminals, the connector having at least one compliant contact member guided for linear travel in a connector housing, the compliant contact member comprising a one-piece body of an electrically conductive material having terminal sections at opposite ends adapted for contact with said external electrical terminals, and a compliant spring section integral with and extending between said terminal sections, the compliant spring section having a length and width and a pair of axially extending opposite edges, the spring section having long, narrow, generally parallel slots alternately opening toward opposite edges of the spring section to form a series of long, narrow-profile beams of electrically conductive material between adjacent slots, in which the beams individually deflect so as to cause the spring section to compress axially under an axial force applied to at least one of said terminal sections, the narrow profile of the beams being formed by the slot having a depth at least about ten times the width of the beams on opposite sides of the slot so that the beams individually deflect through shallow angles about respective pivot points alternating in position along the length of the spring section when the spring section is compressed by said axial force.

24. Apparatus according to claim 23 in which the depth of the slots is at least about ninety percent the width of the spring section.

25. An electrical connector for making compliant electrical contact between a pair of external electrical terminals, the connector having at least one compliant contact member guided for linear travel in a connector housing, the compliant contact member comprising a one-piece body of an electrically conductive material having terminal sections at opposite ends adapted for contact with said external electrical terminals, and a compliant spring section integral with and extending between said terminals sections, the compliant spring section having a length and a width and a pair of axially extending opposite edges, the spring section having long, narrow, generally parallel slots alternately opening toward opposite edges of the spring section to form a series of long, narrow-profile beams for electrically conductive material that individually deflect so as to cause the spring section to compress axially under an axial force applied to at least one of said terminals sections, the narrow profile of the beams being formed by the slot adjacent the beam having a depth substantially greater than the thickness of the beams on opposite sides of the slot and being formed by the ratio of beam thickness to beam length being less than about ten percent so that the beams individually deflect through shallow angles about respective pivot points alternating in position along the length of the spring section when the spring section is compressed by said axial force.

26. Apparatus according to claim 25 in which said ratio is less than about six percent.

27. An electrical contact member for making compliant electrical contact between a pair of external electrical terminals, the contact member having at least one compliant contact member guided for linear travel in a connector housing, the compliant contact member comprising a one-piece body of an electrically conductive material having terminal sections at opposite ends adapted for contact with said external electrical terminals, and a compliant spring section integral with and extending between said terminal sections, the compliant spring section having a length and a width and a pair of axially extending opposite edges, the spring section having long, narrow, generally parallel slots alternately opening toward opposite edges of the spring section to form a series of long, narrow-profile beams of electrically conductive material that individually deflect so as to cause the spring section to compress axially under an axial force applied to at least one of said terminal sections, the narrow profile of the beams being formed by the slot adjacent the beam having a depth substantially greater than the thickness of the beams on opposite sides of the slot so that the beams individually deflect through shallow angles about respective pivot points alternating in position along the length of the spring section when the spring section is compressed by said axial force, and in which the electrical contact member is capable of conducting at least about 30 amperes continuous under an external applied axial force of at least six pounds.

28. Apparatus according to claim 27 in which the spring is a cylindrical member having a diameter and a central axis and the slots external from their open end across the central axis to a closed end.

29. Apparatus according to claim 28 in which the slots have a depth at least about eighty percent of the diameter of the spring section.

30. An electrical connector for making compliant electrical contact between a pair of external electrical terminals for high current-carrying applications, the connector having at least one compliant contact member guided for linear travel in a connector housing, the compliant contact member comprising a one-piece body of an electrically conductive material having terminal sections at opposite ends adapted for contact with said external electrical terminals, and a compliant spring section integral with and extending between said terminal sections, the compliant spring section comprising an elongated generally cylindrical member having a diameter and a central axis and having long, narrow, generally parallel slots alternately opening toward opposite edges of the spring section to form a series of long, narrow-profile beams of electrically conductive material that individually deflect so as to cause the spring section to compress axially under an axial force applied to at least one of said terminal sections, the narrow profile of the beams being defined by the slots on opposite sides of the beams having a depth of at least about eighty percent of the diameter of the spring section, the contact member having a length and cross-sectional area of sufficient size so that the contact member is capable of conducting high current loads of greater than at least about 10 amperes continuous while in its compressed state.

31. Apparatus according to claim 30 in which said depth of the slot is at least ninety percent of the diameter of the spring section.

32. An electrical connector for making compliant electrical contact between a pair of external electrical terminals for high current-carrying applications, the connector having at least one compliant contact member guided for linear travel in a connector housing, the compliant contact member comprising a one-piece body of an electrically conductive material having terminal sections at opposite ends adapted for contact with said external electrical terminals, and a compliant spring section integral with and extending between said terminal sections, the compliant spring section having long, narrow, generally parallel slots alternately opening toward opposite edges of the spring section to form a series of long, narrow-profile beams of electrically conductive material that individually deflect so as to cause the spring section to compress axially under an axial force applied to at least one of said terminal sections, the contact member having a length and cross-sectional area of sufficient size so that the contact member is capable of conducting high current loads of greater than at least about 10 amperes continuous while in its compressed state, and in which the narrow profile of the beams is defined by the ratio of the beam thickness to the beam length being less than about ten percent.

33. Apparatus according to claim 31 in which said ratio is less than about six percent.

34. An electrical connector for making compliant electrical contact between a pair of external electrical terminals, the connector having at least one compliant contact assembly guided for linear travel in a connector housing, the compliant contact assembly comprising a plurality of separate one-piece contact plates of an electrically conductive material having terminal sections at opposite ends adapted for contact with said external electrical terminals, and a compliant spring section integral with and extending between said terminals sections, the compliant spring section of each contact plate having a length and a width and a pair of axially extending opposite edges, the spring section having long, narrow, generally parallel slots alternately opening toward the opposite edges of the spring section to form a series of long, narrow-profile beams of electrically conductive material that individually deflect so as to cause the spring section to compress axially under an axial force applied to at least one of said terminal sections, in which the narrow profile of the beams is defined by the ratio of beam thickness to beam length being less than about ten percent, the contact plates of the contact assembly being disposed face-to-face so as to slide axially with individual compliance when at least one of the plate terminal sections receives said applied axial force.

35. Apparatus according to claim 34 in which said ratio is less than about six percent.

36. Apparatus according to claim 34 in which the connector is a surface-mount connector.

37. Apparatus according to claim 34 in which the connector is adapted for mounting to thru-holes in a printed circuit board.

38. Apparatus according to claim 34 in which the connector is adapted for use as an edge connector for a printed circuit board, in which the connector has a gap that receives the edge of the circuit board, and in which one of said contact assemblies is spring-biased toward a top of the gap and a second of said contact assemblies is spring-biased toward a bottom of the gap so that spring sections of the two spring contact assemblies apply spring-biased pressure to opposite faces of the circuit.

39. Apparatus according to claim 34 in which the contact plates of the contact assembly have the slotted openings of the spring sections reversed to face-to-face contact.

40. An electrical connector for making compliant electrical contact between a pair of external electrical terminals, the connector having at least one compliant contact member guided for linear travel in a connector housing, the compliant contact member comprising a thin, flat one-piece metal plate having terminal sections at opposite ends adapted for contact with said external electrical terminals, and a compliant spring section integral with and, extending between said terminal sections, the compliant spring section having a length and a width and a pair of axially extending opposite edges, the spring section having long, narrow, generally parallel slots alternately opening through opposite edges of the spring section to form a series of long, narrow-profile beams that individually deflect so as to cause the spring section to compress axially under an axial force applied to at least one of said terminal sections, the narrow profile of the beams being formed by the ratio of beam thickness to beam length being less than about ten percent and being formed by the slot adjacent the beam having a depth substantially greater than the thickness of the beams on opposite sides of the slot so that the beams individually deflect through shallow angles about respective pivot points alternating in position along the length of the spring section when the spring section is compressed by said axial force.

41. Apparatus according to claim 40 in which said ratio is less than about six percent.

42. Apparatus according to claim 40 in which the connector includes a plurality of electrically isolated and spaced-apart compliant contact assemblies each adapted for contact with corresponding external electrical terminals, each contact assembly including a plurality of said contact members positioned face-to-face and independently complaint via their respective spring sections.

43. Apparatus according to claim 42 in which the face-to-face contact members have the slots of other spring sections reversed as a mirror image to reduce high frequency effects.

44. Apparatus according to claim 40 in which the connector is a surface-mount connector.

45. Apparatus according to claim 40 in which the connector is adapted for mounting to thru-holes in a printed circuit board.

46. Apparatus according to claim 40 in which the connector is adapted for use as an edge connector for a printed circuit board, in which the connector has a gap that receives the edge of the circuit board, and in which one of said contacts is spring-biased toward a bottom of the gap so the spring sections of the two spring contacts apply spring-biased pressure to opposite faces for the circuit board.

47. Application according to claim 40 in which the spring section is generally rectangular with essentially parallel opposite edges through which the slots alternately open.

48. An electrical connector for making compliant electrical contact between a pair of external electrical terminals, the connector having at least one compliant contact member guided for linear travel in a connector housing, the compliant contact member comprising a one-piece body of an electrically conductive material having terminal sections at opposite ends adapted for contact with said external electrical terminals, and a compliant spring section integral with and extending between said terminal sections, the compliant spring section comprising an elongated member having a predetermined length and width and a central axis extending lengthwise and having long, narrow, generally parallel slots alternately opening toward opposite edges of the spring section, each slot extending from an open end at one edge of the spring section across the width of the spring section to a closed end adjacent an opposite edge of the spring section, to form a series of long, narrow-profile beams of electrically conductive material between adjacent slots, in which the beams individually deflect so as to cause the spring section to compress axially under an axial force applied to at least one of said terminal sections, the slot adjacent opposite sides of the beam each having a radial depth defined by the distance from the central axis of the spring section to the closed end of the slot, the narrow profile of the beams being formed by the narrow slots on opposite sides of the beam having said radial depth substantially greater than the thickness of the beams on opposite sides of the slot so that the beams individually deflect through shallow angles about respective pivot points alternating in position along the length of the spring section when the spring section is compressed by said axial force, in which the electrical contact member is capable of conducting at least 30 amperes continuous under an external applied axial force of at least six pounds.

49. An electrical connector assembly for making compliant electrical contact between a pair of external electrical terminals, the connector assembly having a plurality of compliant contact members guided for linear travel in a connector housing, the compliant contact member comprising a thin, flat one-piece metal plate having terminal sections at opposite ends adapted for contact with said external electrical terminals, and a compliant spring section integral with and extending between said terminal sections, the compliant spring section having long, narrow, generally parallel slots alternately opening through opposite edges of the spring section to form a series of long, narrow-profile beams that individually deflect so as to cause the spring section to compress axially under an axial force applied to at least one of said terminal sections, the narrow profile of the beams being formed by the slot adjacent the beam having a depth substantially greater than the thickness of the beams on opposite sides of the slot so that the beams individually deflect through shallow angles about respective pivot points alternating in position along the length of the spring section when the spring section is compressed by said axial force, each connector assembly including a plurality of said contact members positioned face-to-face and independently compliant via their respective spring sections, and in which the face-to-face contact members have their respective spring sections in surface contact with each other and have the slots of the contacting spring sections reversed as a mirror image to reduce high frequency effects.

50. An electrical connector for making compliant electrical contact between a pair of external electrical terminals for high current carrying applications, the connector having at least one compliant contact member guided for linear travel in a connector housing, the compliant contact member comprising a one piece body of an electrically conductive material having terminal sections at opposite ends adapted for contact with said external electrical terminals, and a compliant spring section of said one piece body integral with and extending between said terminal sections, the compliant spring section comprising an elongated cylindrical member having a predetermined length and width and a central axis extending lengthwise along the cylinder and having long, narrow, generally parallel slots alternately opening toward opposite edges of the cylindrical spring section, each slot extending from an open end at one edge of the spring section across the width of the spring section to a closed end adjacent an opposite edge of the spring section, to form a series of long narrow profile beams of electrically conductive material that individually deflect so as to cause the cylindrical spring section to compress axially under an axial force applied to at least one of the terminal sections, the slots adjacent to opposite sides of each beam having a radial depth defined by the distance from the central axis of the spring section to the closed end of the slot, the contact member capable of conducting high current loads greater than at least 10 amperes continuous while in its compressed state.

* * * * *

UNITED STATES PATENT AND TRADEMARK OFFICE

CERTIFICATE OF CORRECTION

PATENT NO. : 5,865,641
DATED : February 2, 1999
INVENTOR(S) : Mark A. Swart; Charles J. Johnston It is certified that error appears in the above-identified patent and that said Letters Patent is hereby corrected as shown below:

Column 3, line 24, replace "FIG." with -- FIG. 1 --.
Column 4, line 28, replace "slot" with -- slot) --.
Column 5, line 45, replace "profile upper" with -- profile, the upper --.
Column 8, line 21, after "center of" insert -- the --.
Column 8, line 66, change "overlying" to -- overlaying --.
Column 9, line 13, change "overlying" to -- overlaying --.
Column 9, line 44, after "slots," insert -- in which a thickness of the beam is essentially equal to a width of each of the slots on opposite sides of the beam --.
Column 9, line 51, after "formed by" insert -- a ratio beam thickness to beam length being less than about ten percent and --.
Column 9, line 53, change "three" to -- five --.
Column 10, lines 29,30, replace "the ratio of the beam" with -- a ratio of beam --.
Column 10, line 51, After "slots," insert -- in which a width of the beam is essentially equal to a width of each of the slots on opposite sides of the beam --.
Column 11, line 29, change "terminals" to -- terminal --.
Column 11, lines 31,32, replace "the thickness of the"with -- a thickness of each of the --.
Column 12, lines 22,23, change "the width of the" to -- a width of each of the --.
Column 12, line 23, after "slot" insert -- and the beam width is essentially equal to a width of each of the slots on opposite sides of the beam --.

UNITED STATES PATENT AND TRADEMARK OFFICE

CERTIFICATE OF CORRECTION

PATENT NO. : 5,865,641

DATED : February 2, 1999

INVENTOR(S) : Mark A. Swart; Charles J. Johnston

It is certified that error appears in the above-identified patent and that said Letters Patent is hereby corrected as shown below:

Column 11, line 53, change "Application" to --Apparatus--.

Column 12, lines 39,47, change "terminals" to -- terminal -- (both occurrences).

Column 14, line 9, replace "claim 31" with -- claim 32 --.

Column 14, line 20, change "terminals" to -- terminal --.

Column 15, line 36, replace "Application" with -- Apparatus --.

Column 15, lines 64,65, replace "the thickness of the beams" with -- a thickness of each of the beams --.

Column 16, line 4, replace "electrical" with -- compliant --.

Column 16, line 30, replace "each connector assembly including a plurality of said" with -- said plurality of --.

Column 16, line 61, after "slot," insert -- said radial depth substantially greater than a thickness of each of the beams on opposite sides of the slot, --.

Signed and Sealed this

Eleventh Day of July, 2000

*Attest:*

*Attesting Officer*

Q. TODD DICKINSON

*Director of Patents and Trademarks*